United States Patent [19]

Doran et al.

[11] Patent Number: 4,809,981

[45] Date of Patent: Mar. 7, 1989

[54] GOLF PUTTER WITH ALIGNMENT FEATURES

[75] Inventors: Brian A. Doran, Solvang, Calif.; Robert H. Redkey, 1630 Maple, Solvang, Calif. 93463

[73] Assignee: Robert H. Redkey, Solvang, Calif.

[21] Appl. No.: 66,725

[22] Filed: Jun. 25, 1987

[51] Int. Cl.[4] ..... A63B 53/04; A63B 69/36

[52] U.S. Cl. ..... 273/164; 273/167 C; 273/171

[58] Field of Search ..... 273/163 R, 163 A, 164, 273/194 R, 194 A, 183 D, 167 C, 167 B, 167 R, 167 F, 171, 173

[56] References Cited

U.S. PATENT DOCUMENTS

| | | | |
|---|---|---|---|
| D. 230,615 | 3/1974 | Delgadillo | D34/5 GH |
| D. 241,563 | 9/1976 | McCord | D34/5 GH |
| 3,262,705 | 7/1966 | Nunziato | 273/194 R |
| 3,298,693 | 1/1967 | Eisenberg | 273/194 R |
| 3,333,854 | 8/1967 | White | 273/164 |
| 3,343,839 | 9/1967 | Borah | 273/80.2 |
| 3,884,477 | 5/1975 | Bianco | 273/183 D |
| 4,030,766 | 6/1977 | Derr | 273/163 R |
| 4,167,268 | 9/1979 | Lorang | 273/163 A |
| 4,208,053 | 6/1980 | Farr | 273/199 R |
| 4,629,193 | 12/1986 | Pierman | 273/164 |
| 4,722,528 | 2/1988 | Tsao | 273/164 |

FOREIGN PATENT DOCUMENTS

| | | | |
|---|---|---|---|
| 800486 | 12/1968 | Canada | 273/164 |
| 181185 | 6/1922 | United Kingdom | 273/164 |

*Primary Examiner*—George J. Marlo

*Attorney, Agent, or Firm*—Price, Gess & Ubell

[57] ABSTRACT

Golf putters with an alignment sight feature and an alignment ball section located at the club head end for achieving more accurate alignment and stroke of the putter. Toe and heel weighting within the ball section further contributes to greater putting accuracy. In the embodiments, a hemispherical ball section is mounted on a conforming blade and its face serves as the ball striking surface. In one embodiment, a bar mounted at the end of a shaft and an alignment stripe on the ball section form the alignment means, while in a second embodiment a curved metal bar is integrally formed with an overlying alignment bar to form an alignment sight.

8 Claims, 2 Drawing Sheets

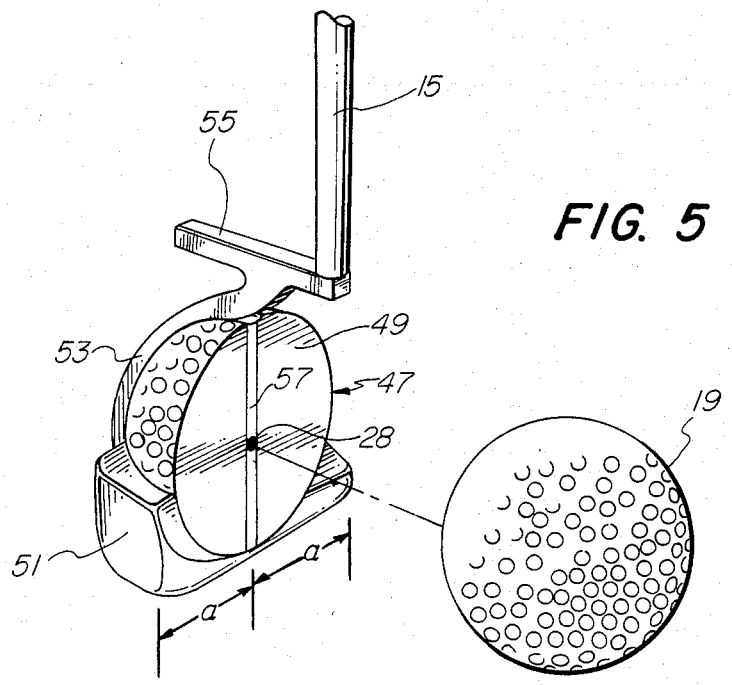
FIG. 5
FIG. 6
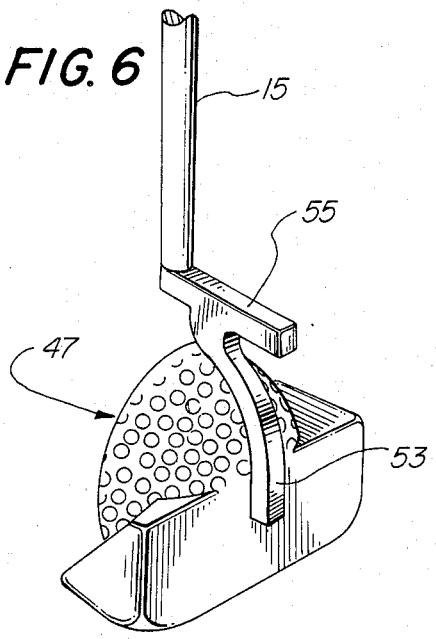
FIG. 7
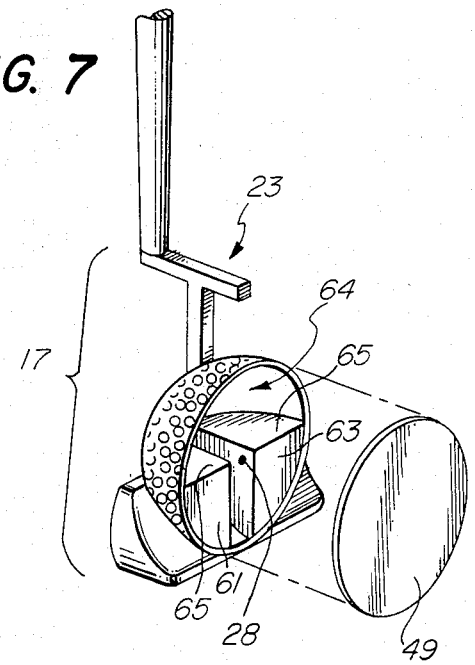

GOLF PUTTER WITH ALIGNMENT FEATURES

BACKGROUND OF THE INVENTION

1. Field of the Invention

The subject invention relates to golf equipment and more particularly to a golf putter with features providing improved accuracy including an alignment sight and weighting system within the circumference of the so called "sweetspot" on the club face.

2. Description of the Related Art

Golf putters are clubs designed primarily for use on putting greens.

In putting, proper ball-putter alignment is required to achieve desired tracking of the ball. It is desirable to align the "sweetspot" surrounding the center of gravity on the club face with the ball.

In the prior art, putter designs for improving alignment of the putter with the ball have been proposed. One design employs a golf ball mounted behind the putter head, which is visually aligned with the ball to be putted. See U.S. Pat. No. 3,343,839.

SUMMARY OF THE INVENTION

Accordingly, it is an object of the invention to provide an improved golf putter;

It is another object of the invention to provide an improved alignment mechanism for a golf putter;

It is yet another object of the invention to provide a golf putter which provides a tracking roll superior to that obtained in the prior art.

It is yet another object of the invention to provide an improved putter incorporating an improved weighting feature.

According to the invention, an improved golf putter is achieved by an alignment sight formed above an alignment ball portion on the head end of the club. The alignment sight lines up with the "sweetspot" on the club face and eliminates visual alignment error. The putter head is further narrowed in width to concentrate its weight toward the sweetspot, which also improves tracking. As an additional feature, heel and toe perimeter weighting is located within the alignment ball portion to further improve performance.

In a first embodiment, a ball section is formed integrally with the putter face and has a centering stripe thereon. A "T"-shaped alignment member extends out of the ball section, providing a horizontal cross-bar. One end of the horizontal cross-bar is attached to the putter shaft, while the other end forms an alignment bar which is visually aligned with the centering stripe by the player.

In a second embodiment, the putter face comprises a golf ball section with a vertical stripe thereon. A curved bar is attached to the rear of the ball and is aligned with the center of the ball section. The curved bar curves upwardly and attaches to a horizontal alignment bar, which is again attached to the putter shaft.

BRIEF DESCRIPTION OF THE DRAWINGS

FIG. 5 is a perspective view illustrating the face side of an alternate putter embodiment according to the invention.

FIG. 6 is a perspective view illustrating the rear of the putter of FIG. 5.

FIG. 7 is a perspective cut away view illustrating perimeter weighting according to the preferred embodiment.

DESCRIPTION OF THE PREFERRED EMBODIMENT

Figure 1:
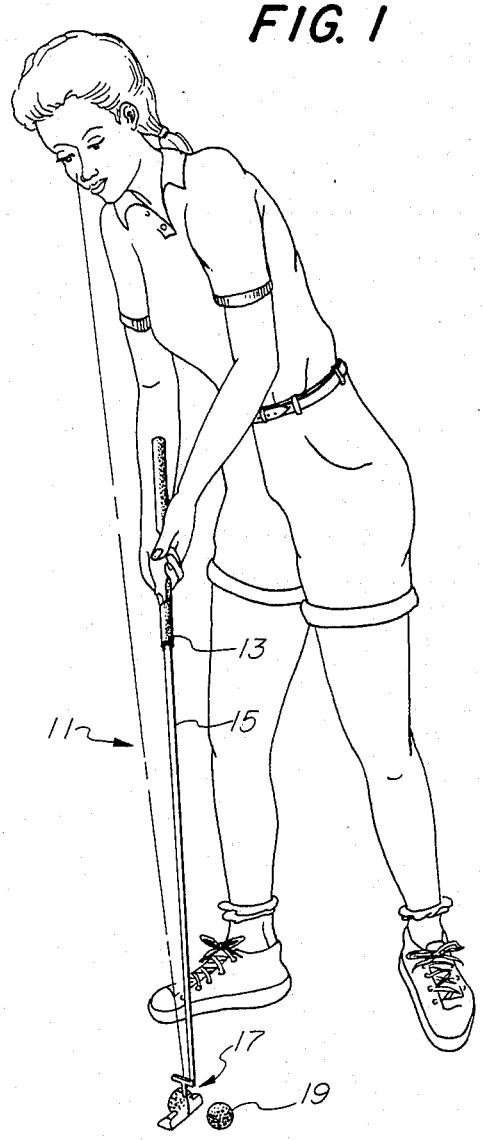
FIG. 1 is a perspective view illustrating a golf putter according to the preferred embodiment of the invention.
Figure 2:
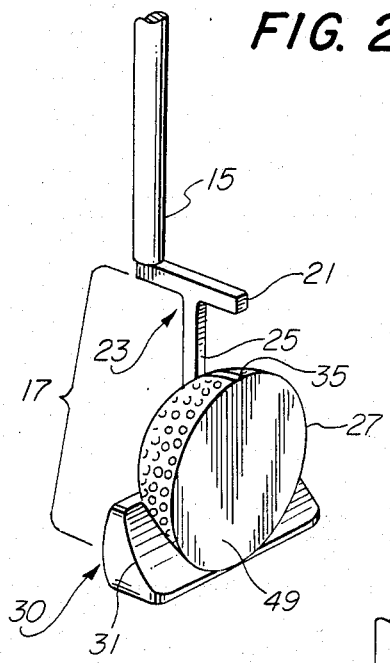
FIG. 2 is a perspective view illustrating the rear of a putter according to the preferred embodiment.
Figure 3:
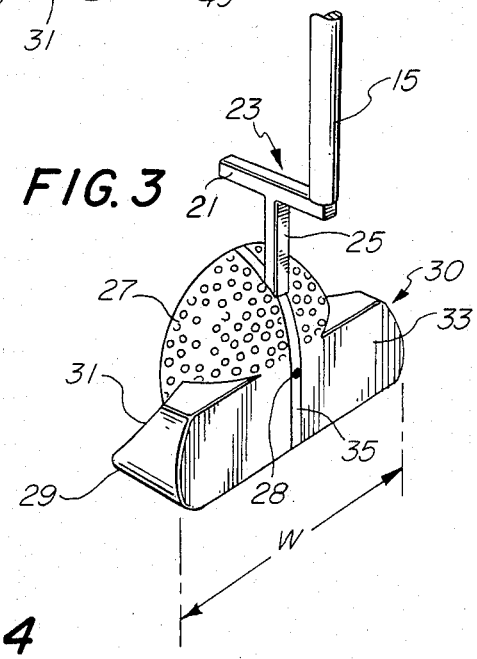
FIG. 3 is a perspective view illustrating the face side of the putter according to the preferred embodiment.

As shown in FIG. 1, the putter 11 according to the preferred embodiment generally includes a grip 13, a shaft 15, and a putter head 17. As shown in FIG. 2, the shaft 15 attaches, e.g. by welding, epoxy, or unitary formation, to the putter head 17. The putter head 17 includes a "T"-shaped alignment mechanism 23, a ball section 27, and a putter blade 30. The putter blade 30 has a concave rear contour 31 and a flat face 33 (FIG. 3). It is preferably formed of metal such as brass, bronze, stainless steel, cast iron, or any other appropriate material.

The putter blade 30 is symmetrically formed about a plane perpendicular to the putter face 33 and in which lies a center stripe 35, which may be painted or otherwise imprinted on the putter face 33. The putter blade width is substantially less than that of a typical putter in order to concentrate the weight of the putter and eliminate inaccuracy. In the preferred embodiment an exemplary width "W" is 2½ inches. This dimension can be varied, for example, increased to greater than 2½ inches.

The ball section 27 is preferably a hemisphere having its flat face 49 rearward and a diameter equal to that of the ball to be struck. The diameter of the ball section 27 is preferably 1.68 inches, the diameter of a standard golf ball.

The ball section 27 is centered with respect to the putter blade 30 and the face 33 such that a plane containing the center stripe 35 bisects the ball section 27. The ball section 27 is preferably cast as one- or two-piece with the putter blade 30 and of the same material.

The embodiment of FIG. 2 includes a "T"-shaped alignment member 23 having a vertical shaft 25 and a horizontal cross-bar 21. The vertical shaft 25 of the "T"-shaped alignment member 23 is attached at a central point of the putter head 29, aligned with the stripe 35. Thus, in the orthogonal top view of FIG. 4, the horizontal bar 21 directly overlies the center stripe 35. The stripe 35 and the ball section 27 are both centrally located to properly direct alignment with the center of gravity 28, which is the center of the "sweetspot" 28 of the putter face 33.

The putter 11 is preferably designed to conform to USGA rules. Accordingly, the center shaft 15 is provided with a lie of ten degrees or greater and the face 33 has a two to four degree loft.

Figure 4:
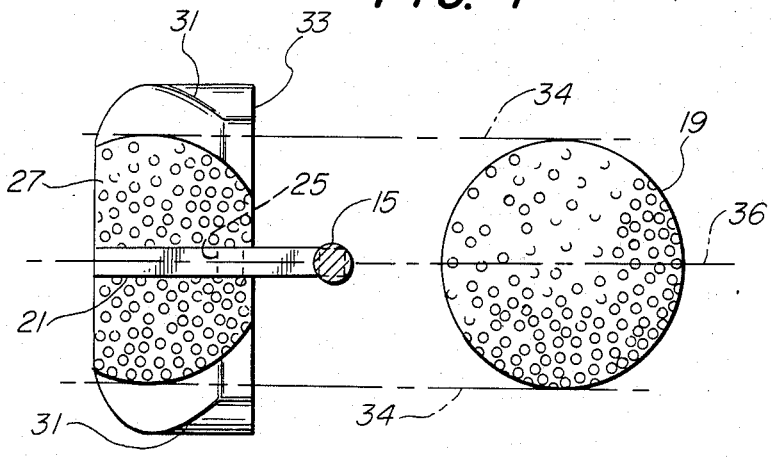
FIG. 4 is a top plan view illustrating alignment of the preferred embodiment.

In use, the putter 11 is aligned as illustrated in FIG. 4. The ball section 27 is visually lined up with a golf ball 19 as indicated by dashed lines 34. The horizontal bar 21 and center stripe 35 line up with the center of the "sweetspot" of the club and the center line 36 of the ball 19. The center stripe 35 and bar 21 effectively form an alignment "sight", which permits the player to avoid visually skewing the angle of the club shaft 15 and otherwise misaligning the club. With the putter 11 thus constructed, improved tracking of the ball 19 results.

In the embodiment of FIGS. 5 and 6, a hemispherical ball section 47 has its face 49 arranged as the ball striking face of the putter 11. The ball section 47 is integrally formed with the metal club head 51. An alignment bar 53 is integrally formed at the rear of the club blade 51 and curves around and conforms to the spherical contour of the ball section 47. The alignment bar 53 then curves upwardly and forms into a horizontal alignment bar 55.

The ball section 47 further has a center stripe 57 painted or otherwise imprinted thereon. The center stripe 57, curved alignment bar 53 and alignment bar 55 all lie substantially in a common plane perpendicular to the substantially rectangular bottom surface of the putter blade 51 and located equidistant from its ends (such that the distances "a" are equal).

In using the embodiment of FIGS. 5 and 6, the player visually aligns the outer contour of the ball section 47 with the outer contour of the ball 19 and visually aligns the two bars 53 and 55 and center stripe 57. Again, an alignment sight is effectively formed by the cooperation of the two bars 53 and 55.

FIG. 7 illustrates an improved perimeter weighting feature which can be incorporated into either of the embodiments of FIG. 2 or FIG. 5. According to this feature, a toe weight 61 and a heel weight 63 are provided within the generally hollow interior 64 of the ball section, e.g. 27. The heel weight 61 and toe weight 63 are mirror images of one another and of equal weight. They are formed of the same material as ball section 27 and have a flat top surfaces 65 coincident with a horizontal plane bisecting the ball section 27. The width between them is varied to determine the amount of weighting desired, e.g. from ½ to 3 ounces on each side. The resulting center of gravity 28 lies just below the geometric center of the ball section 27.

The preferred embodiment may be made according to well-known sandcasting or die casting techniques. For example, according to a typical sandcasting technique, a rubber or aluminum mold is used to form a wax replica of the finished product, in this case, for example, the putter head 17 without the flat face 29 attached. The putter head 17 including the toe and heel weights 61, 63, the ball section 27 and "T"-shaped alignment member 23 may thus be formed as a single wax replica. Once the wax mold is made, it is used to make a ceramic mold by coating the wax mold with a slurry. The wax is then melted out to leave a ceramic mold which can stand high temperatures, e.g. 3,000 degrees Fahrenheit. Metal is then poured into the ceramic mold to form the putter head 17, and the ceramic mold is thereafter broken off. The flat face 29 is then attached to the ball section utilizing a high strength epoxy such as Golfsmith A&B Shafting Epoxy (2000 lb. strength). The same approach is applicable to make either of the embodiments of FIG. 2 or FIG. 5.

An improved alignment mechanism for a golf putter employing a novel sighting mechanism has thus been disclosed. The preferred putters further employ a putter head of narrower width which is closely formed about an alignment ball section and which increases directionality and reduces the possibility of error.

The preferred embodiment further provides periment weighting within the sweetspot. The resulting putter is more consistent with on-center and off-center hits because of a reduction in the twisting of the club head. While various embodiments of the invention have been specifically disclosed above, it will be understood that numerous other embodiments may be fabricated without departing from the scope and spirit of the invention. Therefore, it is to be understood that, within the scope of the appended claims, the invention may be permitted other than as specifically described herein.

What is claimed is:

1. A golf putter comprising:

a shaft;

a hemispherical ball section having a face for striking a golf ball;

a blade formed about a lower portion of said hemispherical ball section, said blade extending on either side of said hemispherical ball section;

an alignment marker means on said ball section for forming a linear alignment segment, said marker means following the hemispherical contour of said ball section and being disposed on a plane perpendicularly bisecting said hemispherical ball section; and a horizontal alignment bar segment extending perpendicular to said shaft and above said linear alignment segment for alignment with said linear alignment segment.

2. The golf putter of claim 1 wherein said alignment marker means comprises a curved marker member formed above said ball section.

3. The golf putter of claim 1 wherein said alignment marker means comprises a stripe marker imprinted on said ball section.

4. The golf putter of claim 1 wherein said ball section includes internal heel and toe weights.

5. The golf putter of claim 4 wherein said internal heel and toe weights are disposed in the lower half of said hemispherical ball section, on opposite sides thereof.

6. The golf putter of claim 5 wherein said heel and toe weights each have an upper surface coincident with a horizontal plane bisecting said hemispherical ball section and are separated by a gap whose width in selected to determine the weight of the respective heel and toe weights.

7. A golf putter comprising:

a shaft;

a hemispherical ball section of the same size as a golf ball, dimpled to resemble a golf ball, and having a flat face for striking a golf ball;

a blade formed about a lower portion of said hemispherical ball section, said blade extending on either side of said hemispherical ball section;

an alignment marker means on said ball section for forming a linear alignment segment, said marker means following the hemispherical contour of said ball section and lying on a plane perpendicularly bisecting said hemispherical ball section;

a horizontal alignment bar segment mounted to said shaft, perpendicular thereto, and above said linear alignment segment for alignment therewith; and internal heel and toe weights disposed in the lower half of said hemispherical ball section, on opposite sides thereof, said heel and toe weights each having an upper surface disposed such that a space comprising a quarter sphere lies above said heel and toe weights, said heel and toe weights being separated by a gap which is substantially rectangular in cross section and whose width is selected to determine the weight of the respective heel and toe weights.

8. The putter of claim 7 wherein the horizontal alignment bar has a first end mounted to one end of said shaft.

* * * * *